US009190754B2

(12) United States Patent
Wang et al.

(10) Patent No.: US 9,190,754 B2
(45) Date of Patent: Nov. 17, 2015

(54) LOWER PROFILE CARD EDGE CONNECTOR FOR SINGLE SIDED SO-DIMM MODULE AND ASSEMBLY OF THE SAME

(71) Applicant: HON HAI PRECISION INDUSTRY CO., LTD., New Taipei (TW)

(72) Inventors: Zhen-Hua Wang, Kunshan (CN); Guang-Lei Xu, Kunshan (CN)

(73) Assignee: HON HAI PRECISION INDUSTRY CO., LTD., New Taipei (TW)

( * ) Notice: Subject to any disclaimer, the term of this patent is extended or adjusted under 35 U.S.C. 154(b) by 185 days.

(21) Appl. No.: 14/027,252

(22) Filed: Sep. 16, 2013

(65) Prior Publication Data

US 2014/0080343 A1 Mar. 20, 2014

(30) Foreign Application Priority Data

Sep. 14, 2012 (CN) ..... 2012 1 0340459

(51) Int. Cl.
*H01R 13/62* (2006.01)
*H01R 12/72* (2011.01)

(52) U.S. Cl.
CPC ..... *H01R 12/721* (2013.01)

(58) Field of Classification Search
CPC ..... H01R 23/682
USPC ..... 439/326
See application file for complete search history.

(56) References Cited

U.S. PATENT DOCUMENTS

| | | | | | |
|---|---|---|---|---|---|
| 3,848,952 | A * | 11/1974 | Tighe, Jr. | ..... | 439/326 |
| 5,041,005 | A * | 8/1991 | McHugh | ..... | 439/326 |
| 5,046,955 | A * | 9/1991 | Olsson | ..... | 439/74 |
| 5,863,213 | A * | 1/1999 | Enomoto et al. | ..... | 439/326 |
| 5,895,281 | A * | 4/1999 | Rothenberger | ..... | 439/326 |
| 6,095,827 | A * | 8/2000 | Dutkowsky et al. | ..... | 439/83 |
| 6,200,144 | B1 | 3/2001 | Wark | | |
| 7,056,154 | B2 * | 6/2006 | Washino | ..... | 439/630 |
| 7,540,742 | B2 * | 6/2009 | Hardell | ..... | 439/65 |
| 7,789,692 | B2 * | 9/2010 | Lee | ..... | 439/327 |
| 8,083,534 | B2 * | 12/2011 | Pipho et al. | ..... | 439/326 |
| 8,303,324 | B2 * | 11/2012 | Franke | ..... | 439/326 |
| 8,647,137 | B2 * | 2/2014 | Kimura | ..... | 439/326 |
| 2008/0032537 | A1 * | 2/2008 | Leidy | ..... | 439/326 |
| 2014/0080343 | A1 * | 3/2014 | Wang et al. | ..... | 439/325 |

FOREIGN PATENT DOCUMENTS

| | | |
|---|---|---|
| CN | 201041840 | 3/2008 |
| TW | 372107 | 10/1999 |
| TW | 532589 | 5/2003 |

* cited by examiner

*Primary Examiner* — Neil Abrams

(74) *Attorney, Agent, or Firm* — Wei Te Chung; Ming Chieh Chang

(57) ABSTRACT

A card edge connector (100) for receiving a module (3) includes an elongated insulative housing (1) having a central slot (10) for receiving a bottom edge of the module and an arm portion (16) coupled to an end of the insulative housing. The arm portion includes a pair of side walls (160) with a retaining slot (168) formed therebetween for receiving a side edge of the module and a latch (17) located between the side walls and integrally extending upwardly from the insulative housing. The latch has a resilient arm (171) defining a retaining embossment (173) for latching the module and a gripping portion (172) for rotating the resilient arm. A number of terminals (2) are mounted on the insulative housing and extend into the central slot for electrical connection to the module.

20 Claims, 7 Drawing Sheets

LOWER PROFILE CARD EDGE CONNECTOR FOR SINGLE SIDED SO-DIMM MODULE AND ASSEMBLY OF THE SAME

BACKGROUND OF THE INVENTION

1. Field of the Invention

The present invention relates to a card edge connector, and more particularly to a card edge connector used for a single sided SO-DIMM MODULE.

2. Description of the Related Art

An electrical card, such as currently popular DDR SDRAM (Double Date Rate Synchronous Dynamic Random Access Memory), includes a plurality of conductive pads, commonly known as Conductive pads or Goldfingers, arranged at one end thereof to form an inserted end and a plurality of electronic components embedded symmetrically on both sides thereof. Generally, a card edge connector is mounted on a mother board and includes a longitudinal slot and two locking devices, the inserted end of said electrical card is inserted into the longitudinal slot and then rotationally to be fixed on the card edge connector by the locking devices, which makes the Conductive pads electrically connected to the conductive terminals of the card edge connector.

As the electronic devices become thinner, reducing the height of the card edge connector becomes a main method, and the height of a normal thin card edge connector commonly used is 4.0 mm, i.e. DDR 3 connectors. However, the method has brought a main disadvantage: the conductive terminals are fixed in the plastic body by an intervention force between the plastic body and the conductive terminals, and the intervention force may cause the thinner plastic body fracture easily. In particular, the slim design of the currently popular thin notebook has reached an unprecedented level.

Therefore, an improved lower profile card edge connector is desired to overcome the disadvantages of the related arts.

BRIEF SUMMARY OF THE INVENTION

An object of the present invention is to provide a lower profile card edge connector and assembly of the same.

In order to achieve above-mentioned object, a card edge connector assembly comprises a card edge connector and an electronic card defining a first surface and a second surface opposite to each other and a mating end having a plurality of Conductive pads thereof. The card edge connector comprises a longitudinal base and a plurality of conductive terminals retained in the longitudinal base. The longitudinal base defines a longitudinal slot for receiving the mating end, the conductive terminals define elastic contacting portions exposed to the longitudinal slot and connecting portions along a mounting surface of the base. The longitudinal slot is defined with an upper inner surface and a lower inner surface inside therein. The first surface of the electronic card is flush with the upper inner surface of the slot and the second surface of the electronic card projects from lower inner surface of the slot to the mounting surface of the base when the electronic card is inserted into the longitudinal slot.

Other objects, advantages and novel features of the invention will become more apparent from the following detailed description of the present embodiment when taken in conjunction with the accompanying drawings.

DESCRIPTION OF PREFERRED EMBODIMENT OF THE INVENTION

Figure 1:
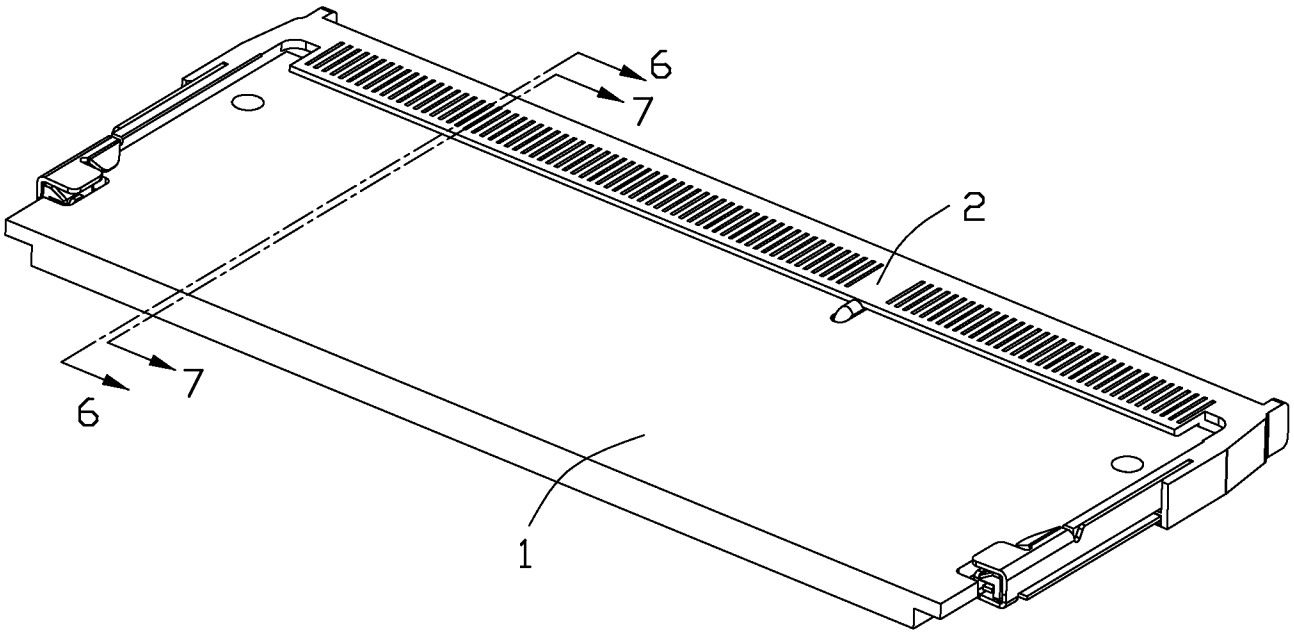
FIG. 1 is a perspective view of a card edge connector assembly in accordance with the present invention.
Figure 2:
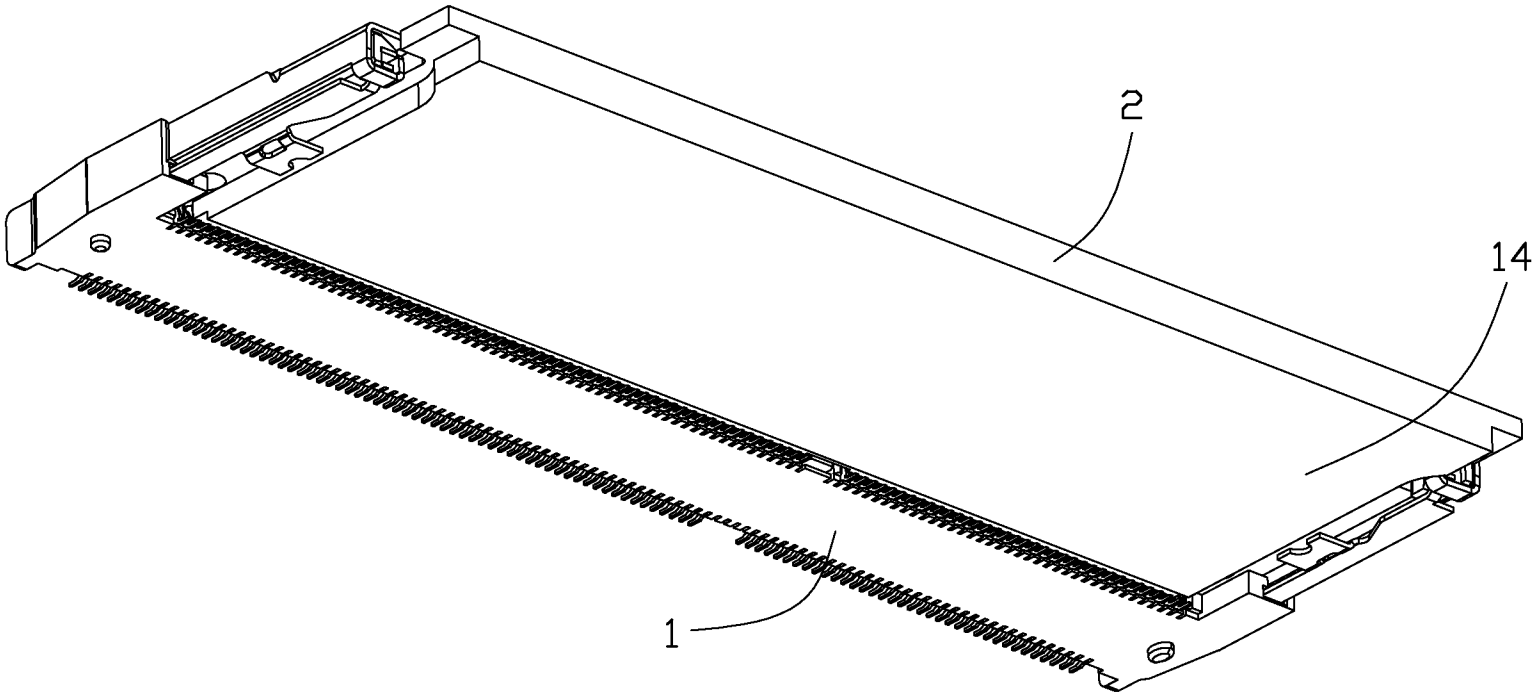
FIG. 2 is another perspective view of the card edge connector assembly shown in FIG. 1.

Reference will now be made to the drawing figures to describe a preferred embodiment of the present invention in detail. Referring to FIGS. 1 to 2, a card edge connector assembly includes an electronic card 1 and a card edge connector 2. The card edge connector 2 is welded on a mother board (not shown) of an electronic device, such as thin laptops, tablet PCs or other similar thin electronic products, and the electronic card 1 is inserted into the card edge connector 2 to achieve signal transmission between the electronic card and the mother board.

Figure 3:
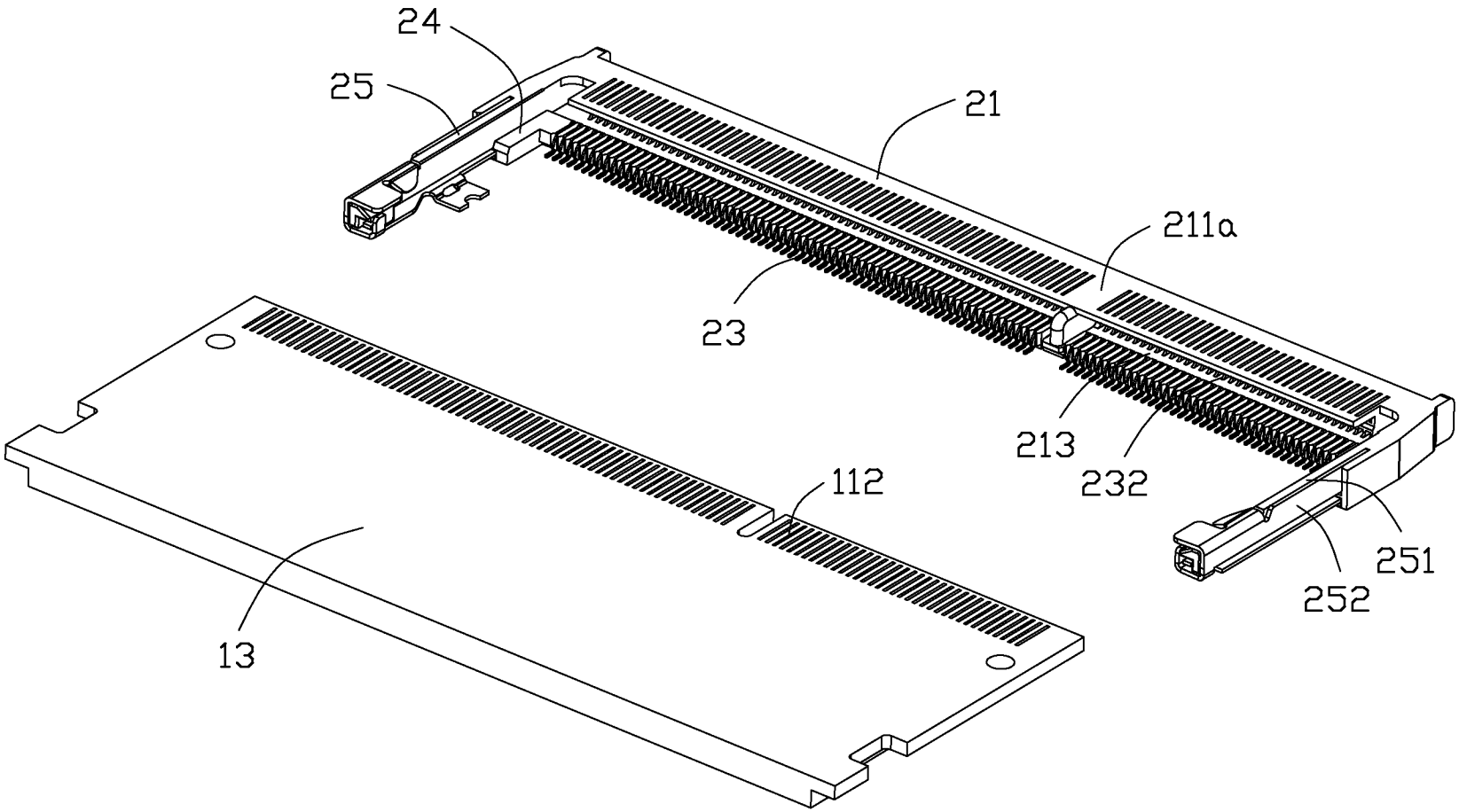
FIG. 3 is a perspective view of the card edge connector assembly of FIG. 1 showing the electrical card unplugged with the card edge connector.
Figure 4:
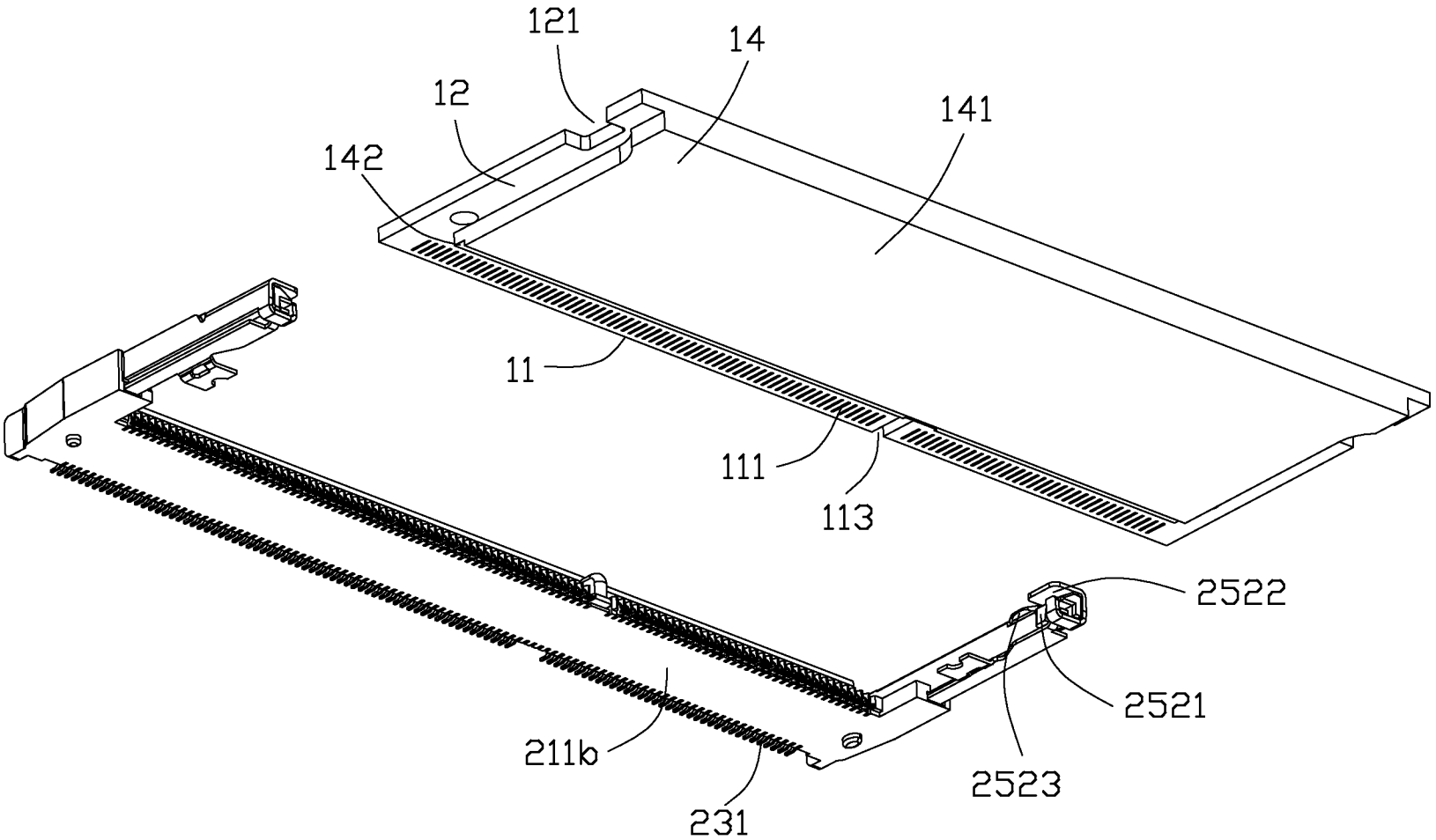
FIG. 4 is another perspective view of the card edge connector assembly shown in FIG. 3.
Figure 5:
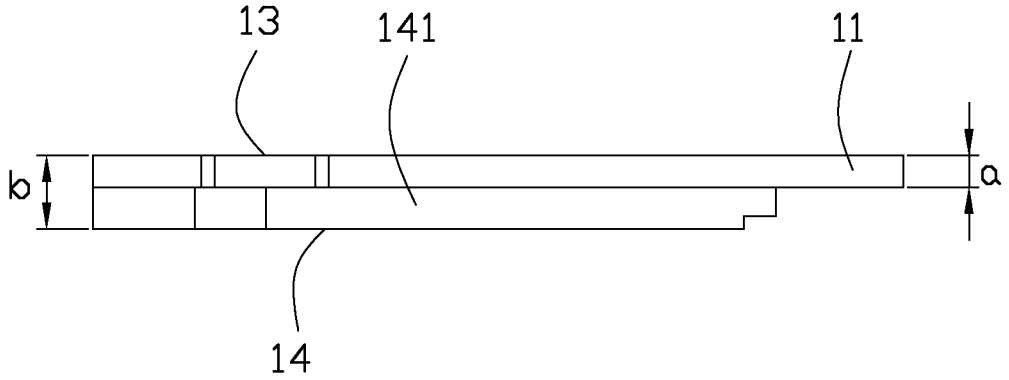
FIG. 5 is a side view of the electrical card shown in FIG. 1.

Referring to FIGS. 3 to 4, the electronic card 1 is configured as a plate-shaped and comprises a plurality of electronic components and circuits (not shown) set on a side thereof only which means a single sided module. The electronic card is longitudinal and forms a mating end 11 at a longitudinal edge thereof, the mating end 11 includes two rows of Conductive pads 111, 112 on both sides thereof and a notch 113 at a predetermined position. The electronic card 1 defines two locked notches 121 each located at a short edge 12 and disposed far away from the mating end 11 for cooperating with locking devices of the card edge connector 2. The plate-shaped electronic card 1 has electronic components or the like which makes the body portion 141 of the electronic card become fatter, the surface setting the electronic components or the like is defined a second surface 14 and the opposite surface is defined a first surface 13. The mating end 11 of the electronic card 1 is flush with the first surface 13, and the second surface 14 of the electronic card is laterally projecting beyond the bottom surface of the mating end 11. Referring to FIG. 5, the thickness a of the mating end 11 is defined as 1.0 mm, the thickness b of the body portion 141 of the electronic card, known as the thickness between the first and second surfaces, is substantially 2.3 mm or less.

Figure 6:
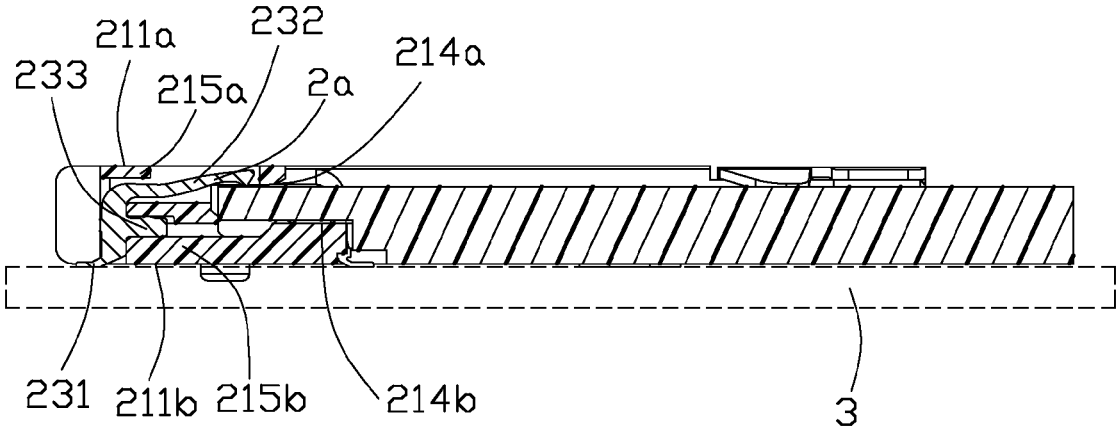
FIG. 6 is a cross-sectional view of the card edge connector assembly shown in FIG. 1 along line 6-6.
Figure 7:
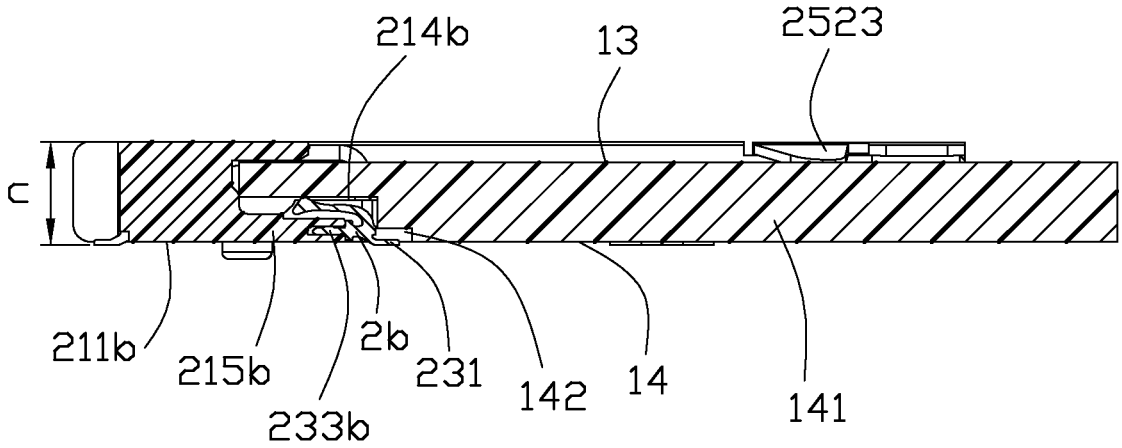
FIG. 7 is a cross-sectional view of the card edge connector assembly shown in FIG. 1 along line 7-7.

The card edge connector 2 comprises a longitudinal insulative base 21 and a plurality of conductive terminals 23, the base has an upper surface 211*a* and a lower surface 211*b* which functioned as forms a PCB mounting surface. A longitudinal slot 213 forwardly runs through the front surface of the base and located between the upper and lower surfaces for receiving the mating end 11 of the electronic card 1. Referring to FIGS. 6 to 7, the longitudinal slot 213 defines an upper inner surface 214*a* and a lower inner surface 214*b*. An upper wall 215*a* and a lower wall 215*b* are located on both sides of the longitudinal slot 213, respectively, the upper inner surface 214*a* and the upper surface 211*a* are located on both sides of the upper wall 215*a*, and the lower inner surface 214*b* and the lower surface 211*b* are located on both sides of the lower wall 215*b*.

The conductive terminals 23 include elastic contacting portions 232 extending into the longitudinal slot 213 and connecting portions 231, the connecting portion 231 extending along the lower surface 211*b* or vertically running through the lower surface. The conductive terminals 23 are arranged in two rows and include upper terminal 2*a* fixed to the upper wall 215*a* and lower terminals 2*b* fixed to the lower wall 215*b*, the height c between the upper and lower surfaces is not more than 3.0 mm and the thickness of the lower wall is not less than 1.3 mm. The conductive terminals 23 also have retaining portions 233, 233*b* located between the elastic contacting portions 232 and the connecting portions 231, the upper terminals 2*a* are inserted into the base 2 from the rear surface of the base and fixed into the upper walls by the interference of the retaining portions 233, and the lower terminals 2*b* are inserted into the base 2 from the front surface of the base and fixed into the lower walls by the interference of the retaining portions 233*b*. Furthermore, the height of the lower wall 215*b* is bigger than the height of the upper wall 215*a*, in other words, the height of the lower wall 215*b* has been greatly increased. Therefore, a certain retaining force is still can be provided when the height of the card edge connector is reduced. As shown in FIG. 4, the second surface of the electronic card defines a recess portion 142 adjacent to the mating end 11 for adapting to the connecting portion 231 of the lower terminals.

The card edge connector 2 further has a pair of locking arms 25 including plastic arms 251 and metal arms 252 respectively extending from both sides of the base 21, each metal arm 252 attaches to the outer surface of the plastic arm 251. The plastic arm 251 includes a locking portion 2521, and the metal arm 252 includes a foolproof piece 2522 located over the locking portion 2521 and a downwardly bending stopping portion 2523 located inside of the foolproof piece 2522. The base 21 defines support surfaces 24 on both sides of the longitudinal slot 213, and the second surface are placed on the support surfaces 24 when the electronic card is inserted into the longitudinal slot 213. The stopping portion 2523 is pressed against the first surface 13 of the electronic card so that the stopping portion 2523 and the support surfaces 24 are pressed against the opposite surfaces of the electronic card, respectively, thereby fixing the electronic card therebetween.

The electronic card is unilateral type in present invention, the second surface 14 with electronic components thereon is downward inclined to insert the mating end 11 into the longitudinal slot 213, and then downwardly rotate the electronic card 1, and two short edges 12 of the electronic card which flush with the mating end 11 get across the locking portion 2521 and are fixed by the stopping portion 2523. As shown as FIGS. 6 to 7, the first surface 13 of the electronic card 1 is flush with the upper inner surface 214*a* of the longitudinal slot 213, the second surface 14 of the electronic card 1 downwardly extends beyond the lower inner surface 214*b* of the longitudinal slot 213 and further flush with the lower surface 211*b*, which means that the fatter body portion 141 of the electronic card 1 is located in front of the lower wall 215*b* of the card edge connector, thereby the space in front of the lower wall of the base 21 is fully utilized. The second surface 14 of the electronic card 1 is not exceeding the upper surface so as to not occupy additional space above the card edge connector. In the height direction of the electronic card 1, the electronic card 1 does not upwardly project beyond the stopping portion 2523 but downwardly project out of the support surface 24, which is the same as the relations between the inner surfaces of the longitudinal slot and the electronic card 1. In an ideal case, the support surface 24 is flush with lower inner surface 214*b* and the lower surface of the stopping portion 2523 is flush with the upper inner surface 214*a*.

In the embodiment of the present invention, the unilateral electronic card 1 can cooperate with the card edge connector 2 to save space. More importantly, because of the design of the fatter second surface 14, the lower wall 215*b* should be provided with a certain thickness which can ensure the lower terminals to obtain better retention, and prevent the plastic base from rupture. In summary, the maximum distance between the first and second surfaces of the electronic card is smaller than the maximum distance between the upper and lower surfaces of the connector.

In actual practice, the elastic contacting portions 232 of the conductive terminals 23 will produce a certain reaction force to the electronic card 1 and the locking arms 25 also have a certain flexibility so that the electronic card 1 will tilt slightly upward when the electronic card is fixed by the locking arms 25, for example the electronic card 1 generally has upturned 0.5 mm in this embodiment. At the same time, different shapes of the terminal 23 have different elastic force so that the electronic card 1 will have different upturned dimension. Therefore, the so-called flush will have a range of offsets, not only refer to the absolute alignment in present invention.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the board general meaning of the terms in which the appended claims are expressed.

What is claimed is:

1. A card edge connector assembly, comprising:

an electronic card defining a first surface and a second surface opposite to each other, and a plurality of conductive pads along a mating end thereof;

a card edge connector comprising a longitudinal base and a plurality of conductive terminals retained in the longitudinal base;

the longitudinal base defining a longitudinal slot to receive the mating end, the conductive terminals defining elastic contacting portions exposed to the longitudinal slot and connecting portions along a mounting surface of the base, the longitudinal slot being defined with an upper inner surface and a lower inner surface inside therein;

wherein the first surface of the electronic card is flush with the upper inner surface of the slot and the second surface of the electronic card projects from lower inner surface of the slot to the mounting surface of the base under a condition that the electronic card is inserted into the longitudinal slot; wherein the longitudinal slot defines an upper wall and a lower wall located on both sides thereof, the upper inner surface and the upper surface are located on both sides of the upper wall, and the lower inner surface and the lower surface are located on opposite sides of the lower wall, the conductive terminals are fixed to the upper and lower walls and the conductive terminals are located in the lower wall and comprise retaining portions interference retained in the lower wall.

2. The card edge connector assembly as described in claim 1, wherein a maximum height between the upper and lower surfaces of the base is not more than 3.0 mm, and a maximum height of the lower wall is not less than 1.3 mm.

3. The card edge connector assembly as described in claim 1, wherein a height of the upper wall is less than a height of the lower wall.

4. The card edge connector assembly as described in claim 1, wherein the mating end of the electronic card is aligned to the first surface, and the second surface of the electronic card projects beyond the mating end and located in front of the lower wall of the card edge connector.

5. The card edge connector assembly as described in claim 4, wherein the card edge connector defines a pair of locking arms, the locking arms are pressed against both edges of the electronic card which are flush with the mating end.

6. The card edge connector assembly as described in claim 4, wherein a notch is located on the mating end of the electronic card, the card edge connector defines a key located in the longitudinal slot for receiving the notch.

7. The card edge connector assembly as described in claim 4, wherein a maximum distance between the first and second surface of the electronic card is smaller than a maximum distance between the upper and lower surface of the card edge connector.

8. The card edge connector assembly as described in claim 1, wherein the lower inner surface of the slot is located around a level of only half of a whole height of the housing.

9. A card edge connector assembly comprising:

an insulative housing defining a central slot extending along a longitudinal direction and forwardly communicating with an exterior in a front-to-back direction perpendicular to said longitudinal direction;

upper and lower passageways, along the longitudinal direction, disposed in the housing and by two sides of the central slot in a vertical direction perpendicular to both said longitudinal direction and said vertical direction;

upper and lower contacts received in the corresponding passageways, respectively with contact sections extending into the central slot;

the upper passageways and the upper contacts being configured to allow the upper contacts to be inserted forwardly into the corresponding upper passageways in said front-to-back direction, respectively, while the lower passageways and the lower contacts being configured to allow the lower contacts to be inserted rearwardly into the corresponding lower passageways in said front-to-back direction, respectively; wherein each of upper passageways defines an upper face downwardly confronting the contacting section of the corresponding upper contact, and a portion of the upper face is removed to have the upper passageway extend upwardly through an upper surface of the housing to have the contacting section of the corresponding upper contact upwardly extend beyond said upper face and move intimately close to the upper surface of the housing for a situation that the contacting section of the upper contact is upwardly deflected by an electronic card inserted into the central slot.

10. The card edge connector assembly as claimed in claim 9, wherein the housing defines opposite upper and lower inner surfaces by two sides of the central slot for intimate confrontation with opposite upper and lower faces a substrate of the inserted electronic card, and the lower inner surface is locate at a level around one half of a full height of the housing.

11. The card edge connector assembly as claimed in claim 9, wherein the housing is configured to allowed the electronic card to be inserted initially at an angle and successively downwardly rotated to a final horizontal position.

12. The card edge connector assembly as claimed in claim 11, wherein said housing is further equipped with a pair of latch arms, and each of said latch arm defines a locking portion at a free end for being received in a corresponding notch in the electronic card, and a stopping portion neighboring to the locking portion for downwardly pressing an upper face of the electronic card.

13. The card edge connector assembly as claimed in claim 9, wherein the inserted electronic card defines a substrate with an electronic component mounted on an undersurface of the substrate, said electronic component being thicker than the substrate.

14. The card edge connector assembly as claimed in claim 13, wherein an upper face of the inserted electronic card is an upper surface of the substrate on which no electronic component is mounted substantially.

15. The card edge connector assembly as claimed in claim 13, wherein the electronic component on the undersurface of the substrate defines a recess for accommodating surface mount tails of the lower contacts.

16. The card edge connector assembly as claimed in claim 13, wherein an undersurface of the electronic component is vertically spaced from a printed circuit board with a first distance which is smaller than a second distance defined between an upper surface of the substrate and the upper surface of the housing.

17. The card edge connector assembly as claimed in claim 9, wherein each of said upper passageways does not extend through a front face of the housing around the upper surface of the housing so as to protect a tip of the contacting section in a hidden manner along said front-to-back direction when said contacting section is deflected upwardly beyond the upper face of the corresponding upper passageway by the inserted electronic card to have the corresponding tip moved close to the upper surface of the housing.

18. A card edge connector assembly comprising:

an insulative housing defining a central slot extending along a longitudinal direction and forwardly communicating with an exterior in a front-to-back direction perpendicular to said longitudinal direction;

upper and lower passageways, along the longitudinal direction, disposed in the housing and by two sides of the central slot in a vertical direction perpendicular to both said longitudinal direction and said vertical direction;

upper and lower contacts received in the corresponding passageways, respectively with contact sections extending into the central slot;

the upper passageways and the upper contacts being configured to allow the upper contacts to be inserted forwardly into the corresponding upper passageways in said front-to-back direction, respectively, while the lower passageways and the lower contacts being configured to allow the lower contacts to be inserted rearwardly into the corresponding lower passageways in said front-to-back direction, respectively; wherein each of said upper passageways extend upwardly through an upper surface of the housing to allow the contacting section of the corresponding upper contact to upwardly extend for a situation that the contacting section of the upper contact is upwardly deflected by an electronic card inserted into the central slot;

wherein the electronic component on the undersurface of the substrate defines a recess for accommodating surface mount tails of the lower contacts.

19. The card edge connector assembly as claimed in claim 18, wherein the housing defines opposite upper and lower inner surfaces by two sides of the central slot for intimate confrontation with opposite upper and lower faces a substrate of the inserted electronic card, and the lower inner surface is locate at a level around one half of a full height of the housing.

20. The card edge connector assembly as claimed in claim 18, wherein the inserted electronic card defines a substrate with an electronic component mounted on an undersurface of the substrate, said electronic component being thicker than the substrate, and wherein an undersurface of the electronic component is vertically spaced from a printed circuit board with a first distance which is smaller than a second distance defined between an upper surface of the substrate and the upper surface of the housing.

* * * * *